United States Patent [19]

Silvenis

[11] Patent Number: 4,618,076

[45] Date of Patent: Oct. 21, 1986

[54] DUAL DISPENSING BOTTLE

[75] Inventor: Scott A. Silvenis, Mauldin, S.C.

[73] Assignee: The Dow Chemical Company, Midland, Mich.

[21] Appl. No.: 515,714

[22] Filed: Jul. 20, 1983

[51] Int. Cl.[4] ..... B05B 9/043; B65D 17/28

[52] U.S. Cl. ..... 222/331; 222/383; 222/481; 222/541; 215/32; 215/252

[58] Field of Search ..... 222/331, 383, 482, 541, 222/487; 239/333; 220/266; 215/32, 252, 253, 33; D9/373, 375

[56] References Cited

U.S. PATENT DOCUMENTS

| | | | |
|---|---|---|---|
| D. 263,930 | 4/1982 | Pardo et al. | D9/373 |
| 1,122,166 | 12/1914 | Smith | 222/482 |
| 1,208,634 | 12/1916 | Paulson et al. | 222/331 X |
| 2,713,952 | 7/1955 | Tessen | 222/482 X |
| 3,159,320 | 12/1964 | Scholtz | 222/482 X |
| 3,182,861 | 5/1965 | Nataf | D9/373 X |
| 3,187,966 | 6/1965 | Klygis | 222/541 |
| 3,199,739 | 8/1965 | Corning et al. | 239/333 X |
| 3,204,835 | 9/1965 | Michel | 215/32 X |
| 3,387,749 | 6/1968 | Godshalk et al. | 222/482 X |
| 3,974,938 | 8/1976 | Steadman | 220/266 |
| 4,019,663 | 4/1977 | Krautkramer | 222/541 X |
| 4,030,664 | 6/1977 | Tisbo et al. | 239/333 X |
| 4,055,282 | 10/1977 | Komendowski | 215/32 X |
| 4,413,753 | 11/1983 | Stock | 222/541 X |

FOREIGN PATENT DOCUMENTS

| | | | |
|---|---|---|---|
| 2417442 | 10/1979 | France | 215/253 |

*Primary Examiner*—Joseph J. Rolla
*Assistant Examiner*—Frederick R. Handren
*Attorney, Agent, or Firm*—L. E. Hessenaur, Jr.

[57] ABSTRACT

A dual dispensing bottle includes two upwardly extending necks having a trigger sprayer attached to one neck and a frangible orifice creating section integrally formed in the other neck. The frangible section is easily removed by twisting and doubles as a plug for the created orifice. The frangible twist-off section enables the consumer to dispense a large amount of product independently of and without removing the trigger sprayer. Since the frangible section is an integral part of the bottle, the easy open/reclose feature is obtained with negligible increase in the manufacturing cost of the bottle.

8 Claims, 7 Drawing Figures

DUAL DISPENSING BOTTLE

BACKGROUND OF THE PRIOR ART

1. Field of the Invention

The present invention relates to a dual dispensing plastic bottle or container, and mcre particularly, to such a container that is adapted for the attachment thereto of a hand-operated trigger sprayer.

2. Description of the Prior Art

The present state of the plastics art no longer requires the storage of voluminous empty bottles or containers, manufacture of such containers from the raw material of thermoplastics by means of known extruder and blowing techniques, including the use of commercially available blow mold equipment, being feasible for small as well as large business concerns. This has contributed significantly to the improvement of profitability in the manufacture of such containers.

Further improvement in profitability of such plastic containers has been achieved by forming, effectively without further cost, a "twist-off" closure for the container opening or orifice as an integral part thereof while the container is still in the mold but after it has been filled with the product that it is intended to hold. When twisted off, the closure forms an outlet opening or orifice for the container through which the product therein may be poured or otherwise taken out. It has also been proposed in the prior art to so configure the twist-off closure as to allow it to be pressed into the orifice to reseal the container.

A need has existed in the prior art for a dual dispensing container (conventionally blow molded or form-/fill/seal), that is one having two outlet openings or orifices, and particularly, such a container that can be used with a hand-operated trigger sprayer for allowing the consumer to selectively dispense, when necessary or desirable and without removing the trigger sprayer from the container, product at a rate that is greater than that which can be dispensed by the trigger sprayer.

This has posed a problem, however, in the identification of a way to achieve this result without adding prohibitively to the manufacturing cost of the container. Proposals made in the prior art to provide a secondary opening or orifice in containers used with trigger sprayers have either been cost prohibitive, involving radical changes to blow mold tooling, additional pieces, and/or additional labor to assemble, or they have required extensive lead times.

SUMMARY OF THE INVENTION

An object of the invention is to provide a dual dispensing plastic container that may be produced using conventional blow molding equipment and that is adapted for the attachment thereto of a finger-actuated pump, for example, a finger tip or trigger sprayer, and includes, as an integrally formed part thereof, a twist-off and resealing closure for allowing product to be dispensed from the container independently of and without removing the finger-actuated pump from the container.

Another object of the invention is to provide for such a dual dispensing container a twist-off and resealing closure that is so characterized as to allow product to be dispensed from the container at a rate that is substantially larger than that which can be dispensed by the finger-actuated pump.

In accomplishing these and other objectives of the invention there is provided a dual dispensing plastic container comprising a hollow body having a first upwardly extending neck and a second upwardly extending neck. The first upwardly extending neck includes external screw threads formed thereon for the attachment thereto of a finger-actuated pump and associated spray nozzle which form a hand-operated trigger sprayer. The attachment is by means of an internally screw threaded cap provided on the sprayer.

A frangible twist-off closure is provided for sealing the second upwardly extending neck, at an upper portion thereof. The twist-off closure is formed without further cost while the container is still in the mold and thus comprises an integral part of the container, as manufactured.

In accordance with one aspect of the invention, the twist-off closure comprises an elongated body having, in a side view, the shape of a parallelogram and having opposed, that is, top and bottom, rectangular sides which, for convenience, will be referred to a first side and a second side. As those skilled in the art understand, various curvatures and geometric shapes may also be used. The selection of the desired shape would be dependent upon: (1) the specific type of conventional blow mold equipment used, and (2) the shape or general contour of the selected finger-actuated pump.

A frangible seal for the second upwardly extending neck is formed on the first side of the elongated body, at one end thereof, for convenience termed the first end. Upon twisting of the elongated body, which twisting is facilitated by the leverage provided by the length of the body, the frangible seal is broken and an outlet opening or orifice is created in the second upwardly extending neck.

Formed on the second side of the elongated body forming the closure, adjacent a second end thereof, is a reclosure or resealing portion that is configured to be pressed into the orifice that was formed in the second upwardly extending neck for resealing the latter.

Thus, liquid product in the container may be selectively dispensed by manipulation of the finger pump or by pouring through the orifice or opening in the second upwardly extending neck upon twisting off of the frangible twist-off closure. Such pouring may be effected independently of and without removing the hand-operated sprayer from the first upward extending neck. After being twisted off, the twist-off closure may be pressed into the orifice to effectively seal the latter.

This arrangement allows the consumer to increase the product use up rate to suit the consumer's requirements and convenience in the use of the product. Additionally, it allows the introduction of products into the container that can be sprayed or poured onto a surface. The feature of the resealing closure minimizes bottle collapse, once the orifice has been created.

BRIEF DESCRIPTION OF THE DRAWINGS

Having summarized the invention, a detailed description follows with reference being had to the accompanying drawings which form part of the specification, of which.

DESCRIPTION OF THE PREFERRED EMBODIMENT

Figure 1:
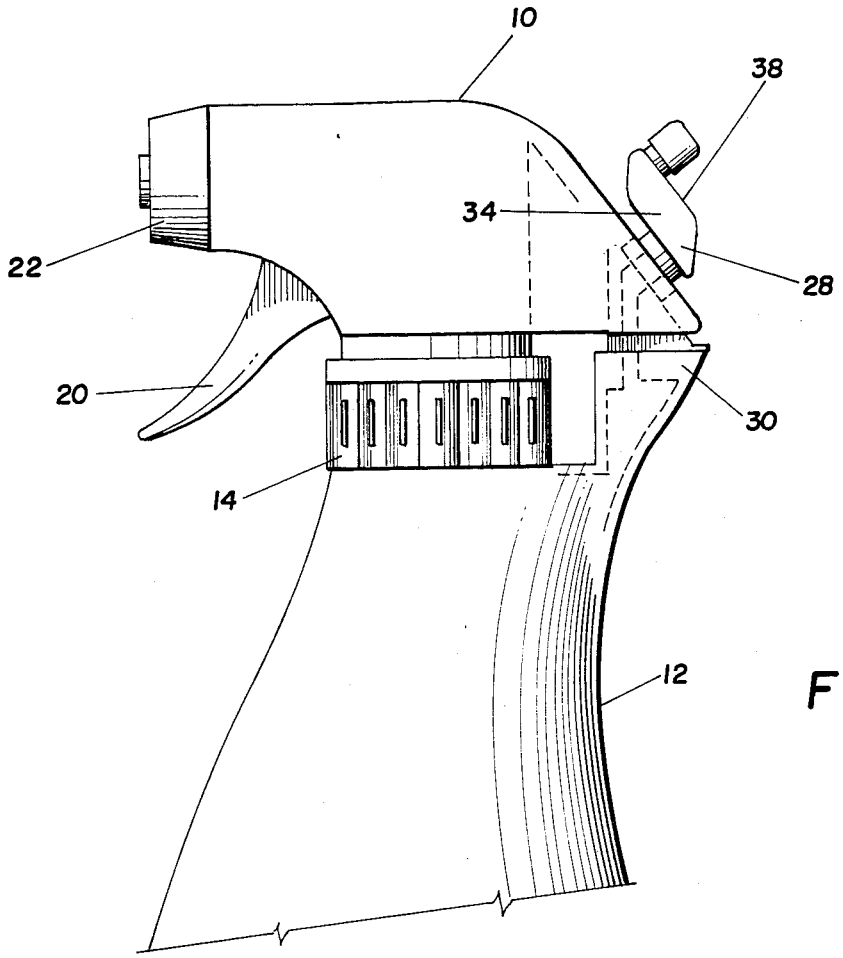
FIG. 1 is a fragmented side elevation of a container embodying the invention shown with a hand-operated trigger sprayer attached thereto and incorporating a frangible twist-off closure having a reseal feature.
Figure 2:
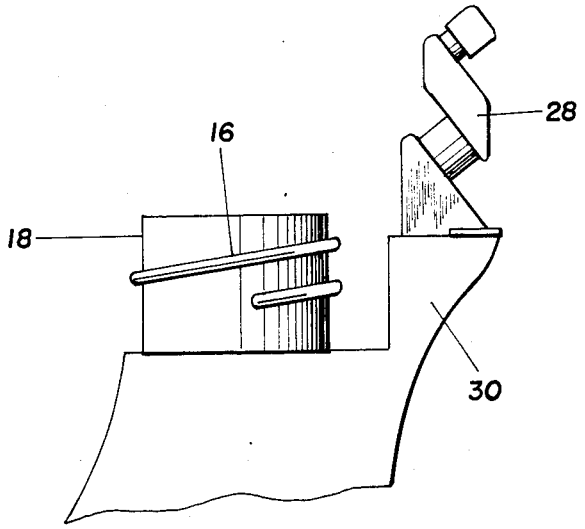
FIG. 2 is a fragmented side elevation of the upper structure of the container of FIG. 1 as manufactured, and with the trigger sprayer removed.
Figure 3:
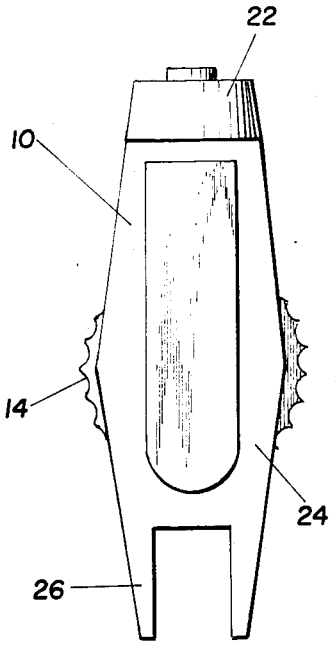
FIG. 3 is a top view of the hand-operated sprayer of FIG. 1.
Figure 5:
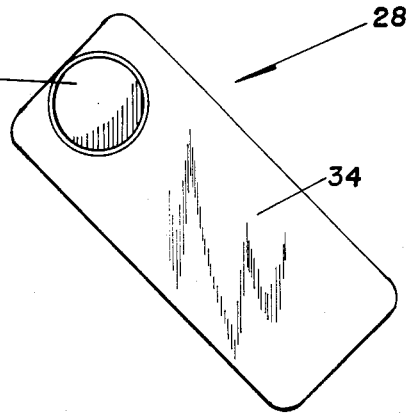
FIG. 5 is a plan view of the frangible twist-off closure.

As shown in FIG. 1, a hand-operated plastic trigger sprayer 10 is attached to the top of a dual dispensing plastic container 12 by means of a screw cap 14 that, as seen in FIG. 2, is adapted to engage a screw thread 16 on a first upwardly extending neck 18 of the container 12. The trigger sprayer 10 may be of any commercially available type such as hand-operated sprayers used for dispensing household cleaning fluids and includes a finger-actuated pump (not shown) that is actuable by a trigger 20 and an associated spray nozzle 22. Nozzle 22 may be of an adjustable type having several positions of adjustment, for example, "OFF", "SRPAY", and "STREAM". Preferably, as shown, in FIG. 3 the trigger sprayer shroud 24 is bifurcated, that is, provided with a two-pronged fork 26 at the end thereof remote from the nozzle 22 to accommodate a closure 28 that is provided at the upper end of a second upwardly extending neck 30 that is provided on the container 12.

Figure 4:
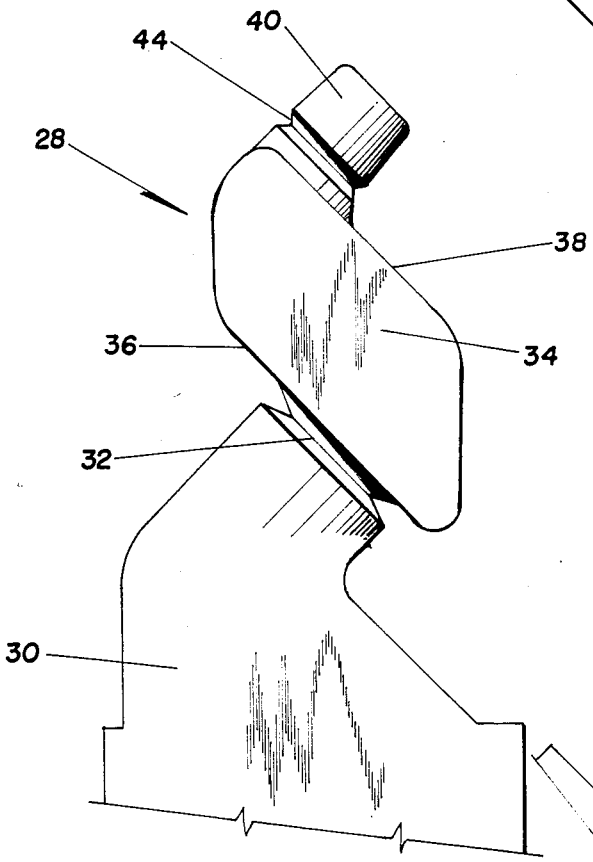
FIG. 4 is an enlarged view of a portion of the upper structure of FIG. 2, showing, in more detail, the frangible twist-off closure and the container upper extending neck that is associated therewith.

Closure 28, as best seen in FIGS. 2 and 4–6, is formed as an integral part of the container 12 while the container 12 is still in the blow molding equipment, and hence, is obtained with a negligible increase in the cost of manufacturing the container 12. Closure 28 comprises a frangible orifice creating section, indicated at 32 in FIGS. 4 and 6, that is easily removed and consists of a hollow elongated body 34 having the shape of a parallelogram in side view, as seen in FIGS. 1, 2 and 4, with opposed lower and upper sides, that is, a lower or first side 36 and an upper or second side 38, each having the shape of a rectangle.

Figure 7:
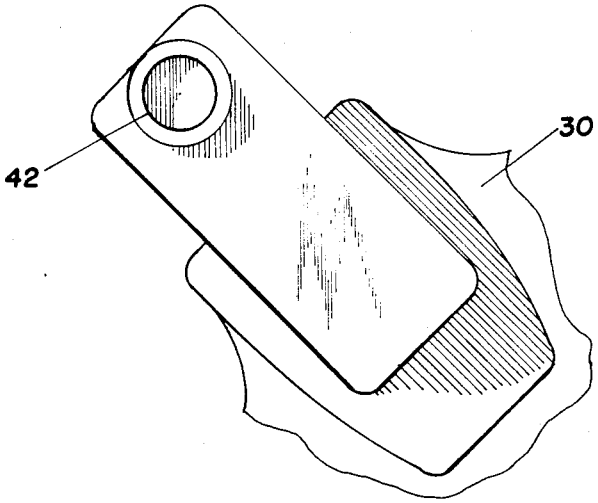
FIG. 7 is a view of the upper end of the upper extending neck associated with the frangible twist-off closure with the latter removed.

The orifice creating section 32 of closure 28 is located on the first side 36 of body 34, adjacent a first end thereof, specifically the end at which the parallelogram shape, in side view, has the acute angle. Formed on the second side 38 of body 34, adjacent the other, or second end, thereof is a tapered plug 40 which may be used to reclose or reseal the orifice that is created in the upper end of the second upwardly extending neck 30 when the closure 28 is twisted off. The orifice, designated 42, that is formed in the upper end of neck 30 when closure 28 has been twisted off is illustrated in FIG. 7.

Figure 6:
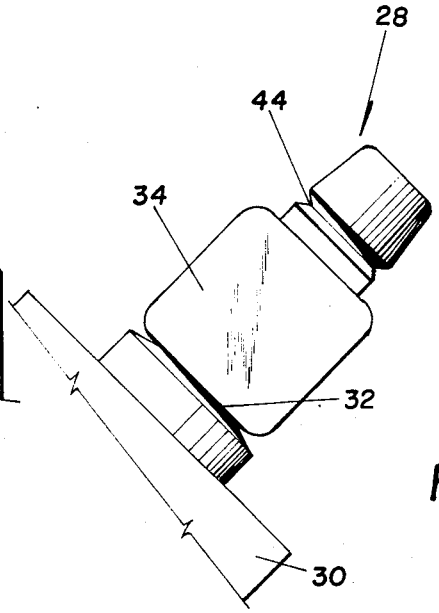
FIG. 6 is an end view of the frangible twist-off closure as seen from the right in FIGS. 1 and 4.

It is noted that the twisting off of the closure 28 from the upper end of neck 30 is facilitated by the lever arm that is provided as a result of locating the frangible section 32 adjacent the first end of the elongated body 34. Similarly, the location of the plug 40 adjacent the second end of the body 34 facilitates the pressing in of the plug 40 in the orifice 42 in neck 30 that is created by the frangible section 32. For effecting a tight closure of the orifice 42 in the neck 30 and facilitating placement of the plug 40 therein, the plug 40 desirably is tapered, that is, the external diameter is gradually decreased toward the outer end thereof, as best seen in FIGS. 4 and 6. An undercut ring or groove 44 which is provided on tapered plug 40, as shown, helps the plug 40 stay in the orifice 42 by restraining the plug 40 from backing out.

Thus, in accordance with the invention, there has been provided a dual dispensing plastic container, container 12, that may be produced using conventional blow molding equipment that is adapted for the attachment thereto of a finger-actuated pump and that allows the consumer selectively to dispense product from the container by manipulation of the sprayer or to dispense a larger amount of product from the container than the trigger sprayer can handle without removing the trigger sprayer from the container. The invention is characterized in that closure 28 with the frangible orifice creating section 32 and reclosing or sealing tapered plug 40 is obtained at negligible cost using conventional blow molding equipment while the container 12 is being formed and is still in the blow mold.

The invention enables the consumer to increase product use rate conveniently, enables the manufacturer to introduce products which can be sprayed or poured onto a surface, and after the orifice has been created, by virtue of the reclosing feature of closure 28, minimizes collapse of container 12 and enables continued use of the trigger sprayer 10.

What is claimed is:

1. A container comprising a hollow body having a first upwardly extending neck and a second upwardly extending neck, said first upwardly extending neck being provided with coupling means for, and said container being adapted for, the connection thereto of a finger actuated pump and associated spray nozzle having mating coupling means, a frangible twist-off closure for sealing said second upwardly extending neck and having an elongated body, said twist-off closure being formed as an integral part of the hollow body and continuous with said second neck, and joined to said second neck by a reduced thickness joining portion to facilitate separation thereof from said second neck by twisting, said twist-off closure further having a reclosure portion formed thereon, said reclosure portion being adapted to be pressed into the opening that is formed in said second upwardly extending neck by removal of said twist-off closure, and sized for reclosing the opening, when said twist-off closure has been twisted off said second upwardly extending neck, and means including the extent of elongation of said elongated body and the position of said frangible closure on said elongated body for providing leverage in twisting said frangible closure to effect rupture thereof; wherein said elongated body has a first side and a second side, said first side and said second side being disposed in opposing relation with respect to said elongated body, with said first side including a frangible seal for said second upwardly extending neck, and with said second side having said reclosure portion formed thereon; and wherein said frangible seal is positioned on said first side adjacent one end of said elongated body and said reclosure portion is positioned on said second side adjacent the other end of said elongated body whereby there is provided said leverage in twisting said twist-off closure of said second upwardly extending neck and in twisting said reclosure portion to facilitate the pressing thereof into the opening in the second upwardly extending neck.

2. A container as specified in claim 1 wherein said reclosure portion of said twist-off closure is tapered to facilitate placement of said reclosure portion in the opening formed in said second upwardly extending neck when said twist-off closure has been twisted off and to effect a tight closure of said opening.

3. A container as specified in claim 2 wherein said tapered reclosure portion is a tapered plug having an undercut ring for restraining said plug against backing out when placed in said opening.

4. A container as specified in claim 1 including a finger actuated pump and associated spray nozzle connected in operative relation to said first upwardly extending neck of said hollow body whereby product contained in said hollow body may be selectively dispensed by the manipulation of said finger pump, or by pouring through the opening in said second upwardly extending neck upon twisting off said frangible twist-off closure without removal of said finger pump and associated spray nozzle from said first upwardly extending neck.

5. A plastic container comprising a hollow body having a first upwardly extending neck and a second upwardly extending neck, said first upwardly extending neck being adapted for the connection thereto of a finger actuated pump and associated spray nozzle, a frangible twist-off closure for sealing said second upwardly extending neck, said twist-off closure being formed as an integral part of the hollow body and comprising an elongated body having a first side and a second side, said first side and said second side being disposed in opposing relation with respect to said elongated body, said first side including adjacent one end of said elongated body, a frangible seal for said second upwardly extending neck which seal is fractured upon twisting of said twist-off closure to form an orifice in said second upwardly extending neck and said second side including adjacent the other end of said elongated body a reclosure portion that is adapted to be pressed into the orifice formed in said second upwardly extending neck upon twisting off of said twist-off closure for reclosing the orifice.

6. A container as specified in claim 5 including a finger actuated pump and associated spray nozzle connected in operative relation to said first upwardly extending neck of said hollow body whereby product contained in said hollow body may be selectively dispensed by the manipulation of said finger pump or by pouring through the orifice in said second upwardly extending neck upon twisting off of said frangible twist-off closure without removal of said finger pump and associated spray nozzle from said first upwardly extending neck.

7. A container as specified in claim 5 wherein said reclosure portion of said twist-off closure is tapered to effect a tight closure of the orifice formed in said second upwardly extending neck upon twisting off of said twist-off closure.

8. A container as specified in claim 7 wherein said tapered reclosure portion includes an undercut ring for restraining said reclosure portion from backing out when placed in said orifice.

* * * * *